US008430223B2

(12) United States Patent
Aguirrezabala Olasagasti

(10) Patent No.: US 8,430,223 B2
(45) Date of Patent: Apr. 30, 2013

(54) SYMMETRICAL LOCK WHICH CAN BE OPERATED BY MEANS OF TWO COINS

(75) Inventor: Joseba Jokin Aguirrezabala Olasagasti, Elgoibar (ES)

(73) Assignee: Ojmar, S.A., Elgoibar (Gipuzkoa) (ES)

( * ) Notice: Subject to any disclaimer, the term of this patent is extended or adjusted under 35 U.S.C. 154(b) by 184 days.

(21) Appl. No.: 13/061,920

(22) PCT Filed: Feb. 16, 2009

(86) PCT No.: PCT/ES2009/000088
§ 371 (c)(1),
(2), (4) Date: Mar. 2, 2011

(87) PCT Pub. No.: WO2010/034850
PCT Pub. Date: Apr. 1, 2010

(65) Prior Publication Data

US 2011/0155537 A1 Jun. 30, 2011

(30) Foreign Application Priority Data

Sep. 26, 2008 (ES) ..... 200802777

(51) Int. Cl.
*G07F 17/10* (2006.01)
*G07F 17/14* (2006.01)

(52) U.S. Cl.
USPC ..... 194/247; 70/DIG. 41

(58) Field of Classification Search ..... 194/247, 194/290; 70/57, 77, 78, 81, 110, 344, DIG. 41
See application file for complete search history.

(56) References Cited

U.S. PATENT DOCUMENTS

| | | | | |
|---|---|---|---|---|
| 4,433,772 | A | 2/1984 | Eisermann et al. | |
| 4,953,683 | A | 9/1990 | Eisermann | |
| 5,573,098 | A * | 11/1996 | Widmer | 194/212 |

FOREIGN PATENT DOCUMENTS

| | | | |
|---|---|---|---|
| DE | 3124180 | A1 | 12/1982 |
| DE | 10350951 | A1 | 5/2005 |
| DE | 102005043667 | A1 | 3/2007 |
| ES | 2216658 | A1 | 10/2004 |
| ES | 2300727 | A1 | 6/2008 |
| GB | 2383670 | A | 7/2003 |

* cited by examiner

*Primary Examiner* — Mark Beauchaine
(74) *Attorney, Agent, or Firm* — Lucas & Mercanti, LLP

(57) ABSTRACT

Symmetrical lock which can be operated by means of two coins, consisting of a casing with two slots for the insertion of respective coins and a tongue displaceable in a left/right direction. It is characterized in that:

a) the casing has a longitudinal plane of symmetry;
b) two tongue stops opposite the coins and a dog engaging with one or both tongue stops are provided, the three elements being arranged on the same pivoting axis;
c) the tongue has an opening with a notch with which the ends of the dogs interfere when the tongue is displaced in the absence of coins, and with an end seat for said ends when the tongue is displaced in the presence of coins;
d) below the opening and on each side of the tongue there are respective fixed stops and respective movable stops which are coupled together by means of a positioning lever driven by the tongue via a pin on which it is able to pivot.

12 Claims, 7 Drawing Sheets

SYMMETRICAL LOCK WHICH CAN BE OPERATED BY MEANS OF TWO COINS

This application is a 371 of International Application PCT/ES2009/000088 filed Feb. 16, 2009, which claimed the priority of Spanish Application P200802777, filed Sep. 26, 2008, the priority of both applications is hereby claimed and both applications are incorporated by reference herein.

This invention refers to a lock, of the type that are operated by inserting coins, and more specifically, a lock of the type that operate by inserting two coins at the same time.

In the current state of the art, coin locks are already known that operate by inserting two coins simultaneously; examples that can be cited are, among others, patents DE3124180 and DE10350951 and U.S. Pat. No. 4,433,772.

The known locks of this type present complex structure, which firstly, makes their manufacture more difficult (because they require a large number of components and the final assembly of all of them is complicated) and secondly, their storage (due to the large quantity of replacement parts needed in stock).

The new lock that is the object of the invention simplifies the structuring of these types of locks. In it, many of its components present constructive symmetry and are even totally identical to each other; thus, they are positionally interchangeable (which results in the manufacture of a lower number of total components). It is characterized in that it consists of:

- A casing, with two upper slots to accept two coins at the same time. In the casing there are two tongue stops and a dog engaging with at least one of them, both tongue stops and the dog being arranged on the same pivoting axis on said casing.
- A tongue that has an opening with a notch with which the ends of the dogs interfere when the tongue is displaced in the absence of coins, and with an end seat for the ends of the dogs when the tongue is displaced in the presence of the coins.
- A fixed stop and a movable stop, arranged on each side of the tongue, and under said opening, both movable stops coupled together by means of a positioning lever driven by the tongue via a pin on which it is able to pivot.
- A lift, arranged between the tongue lever and the tongue, coaxially aligned with the tongue lever and accessible in turning from the outside with a master key; said lift consisting of an eccentric head which, in its turning movement, interferes with one of the tongue stops and with the dog, forcing them to pivot and the dog pushing and turning the other tongue stop so that the ends of the tongue stops are raised in their pivoting above the notch of the opening.

It is also characterized in that:

- the casing has a longitudinal plane of symmetry
- the two upper slots are identical to each other
- the two coins are arranged on each side of the tongue
- the two tongue stops are identical to each other
- the tongue stops, the dog and the positioning lever each have a transverse plane of symmetry
- the cover of the casing has a plane of symmetry that passes through the centre of its opening and a support for the key cylinder of the lock Therefore, the proposed coin lock constitutes a new invention that involves inventive activity, and can be applied industrially.

To better understand the object of this invention, a preferential practical embodiment is shown on the diagrams, subject to complementary changes that do not essentially alter it.

The following is an example of practical, non-limiting embodiment of this invention. Other forms of embodiment in which complementary changes are introduced that do not essentially alter it are not disregarded; on the contrary, this invention also includes all its variations.

Figure 1:
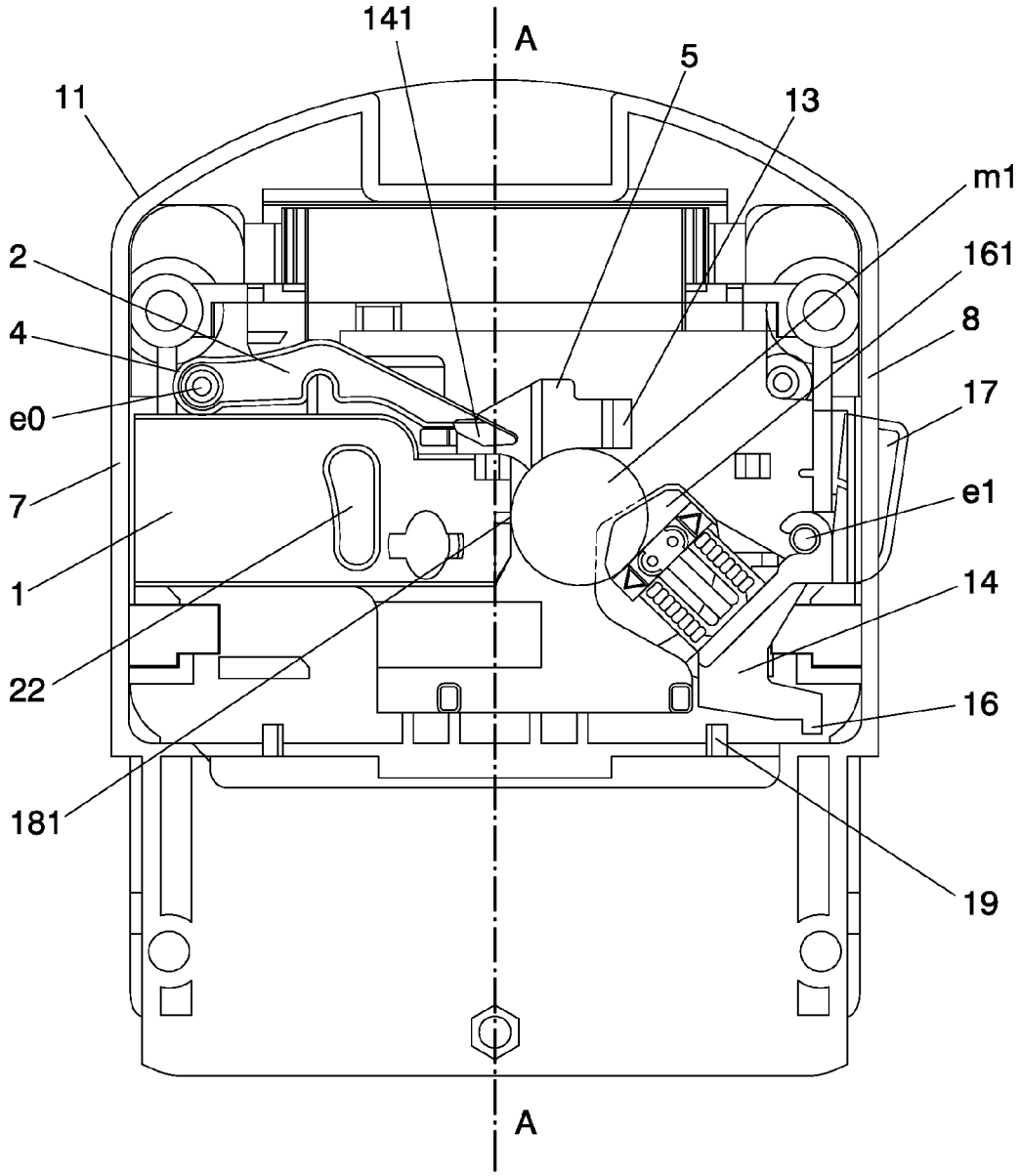
FIG. 1 shows a schematic general elevation view of the coin lock which is the object of the invention, with the cover removed (30) to observe the arrangement and assembly of its interior components.

This invention involves a new coin lock in which, according to the embodiment shown, the casing (11) has two slots at the top (r1), (r2) and two openings on the side (7), (8). It has a longitudinal plane of symmetry A:A so that the upper slots (r1), (r2) face each other (against each other) and the side openings (7), (8) face each other (aligned) on two opposite sides—see FIGS. 1 and 2—.

Figure 2:
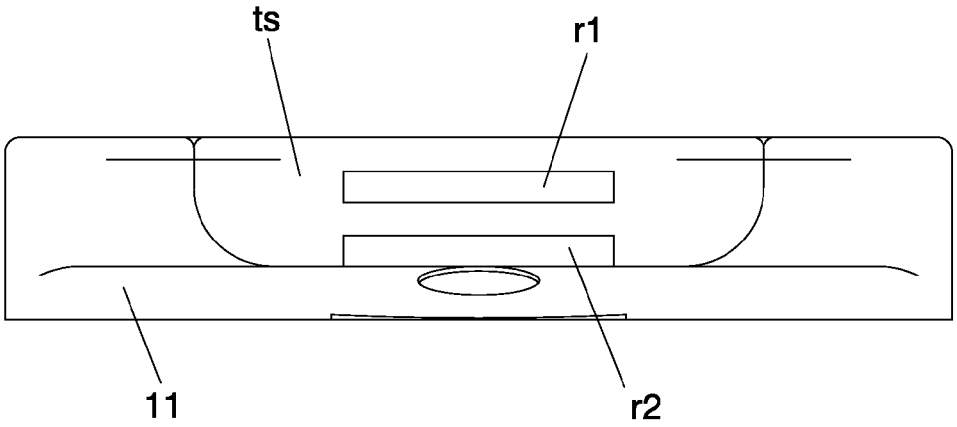
FIG. 2 shows a schematic general plan view, corresponding to the foregoing figure, for a specific—non-limiting—example of embodiment, in which the assembly/casing is structured in a casing (11) and a top cover (ts) in which two slots (r1), (r2), have been made, the longitudinal plane of symmetry A:A passing through the centre of both slots (r1), (r2) facing each other.

It is complementary to the purpose of the invention, and is included in the object of the same, that the upper slots (r1), (r2) are made in the casing itself (11) or in a separate upper cover (ts)—as shown in FIG. 2—

Figure 6:
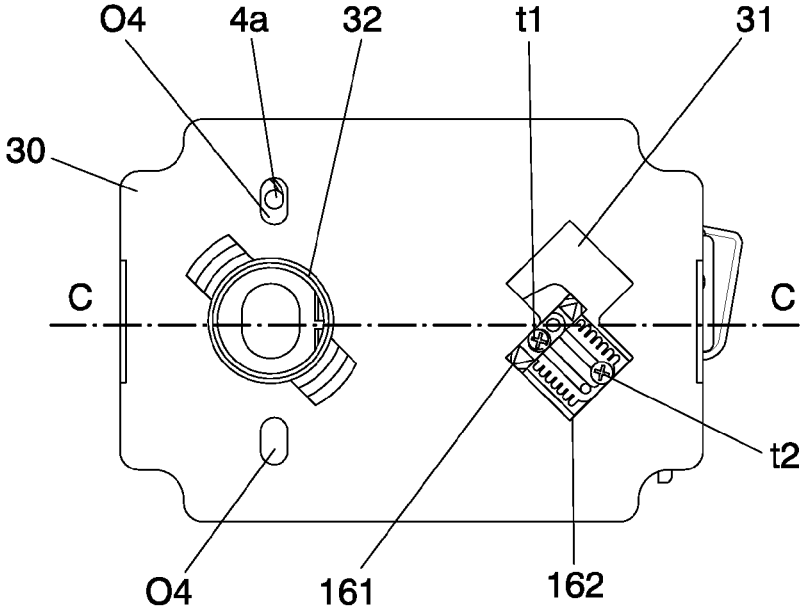
FIG. 6 shows a schematic general elevation view of the coin lock which is the object of the invention, viewed from the side of its cover (30), to view the access orifices (O4), through either of which access is allowed to the pin (4*a*) of the tongue stop dog (4).
Figure 3:
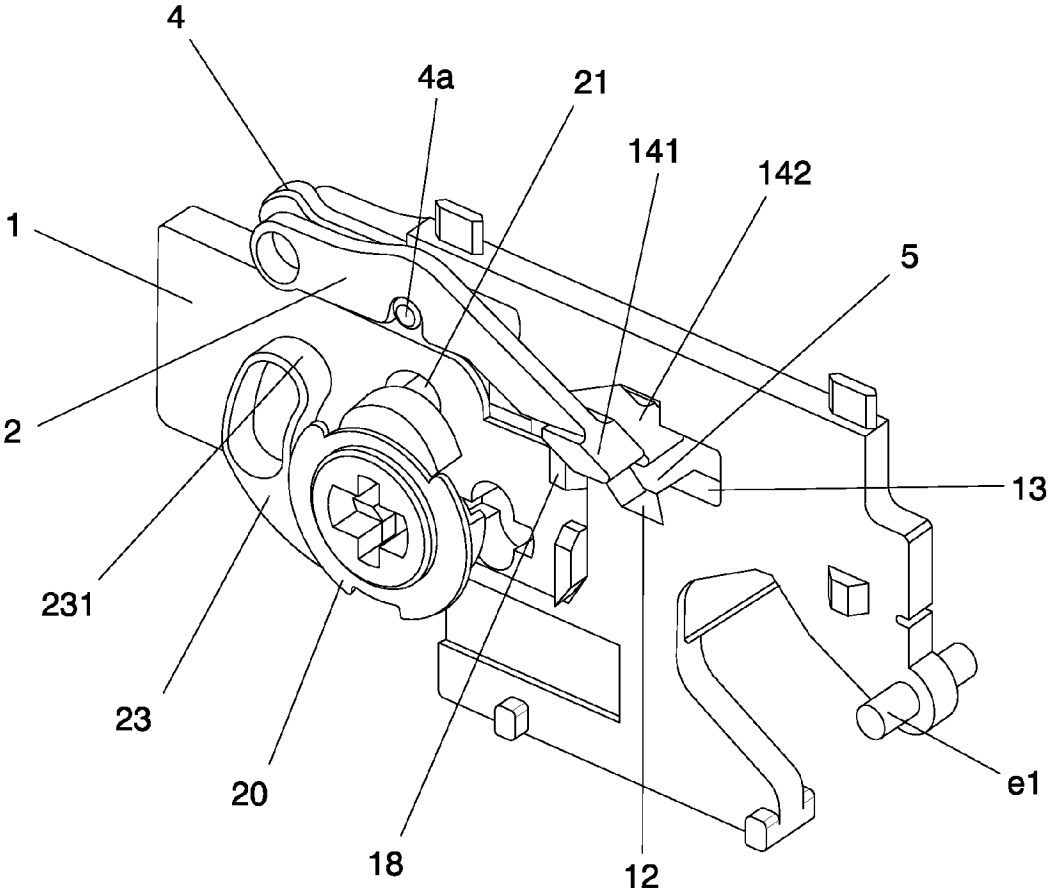
FIG. 3 shows a general diagram of the coin lock which is the object of the invention without the casing (11) and cover (30) as well as the positioning lever (14), for a better view of the arrangement of the interior components.
Figure 4:
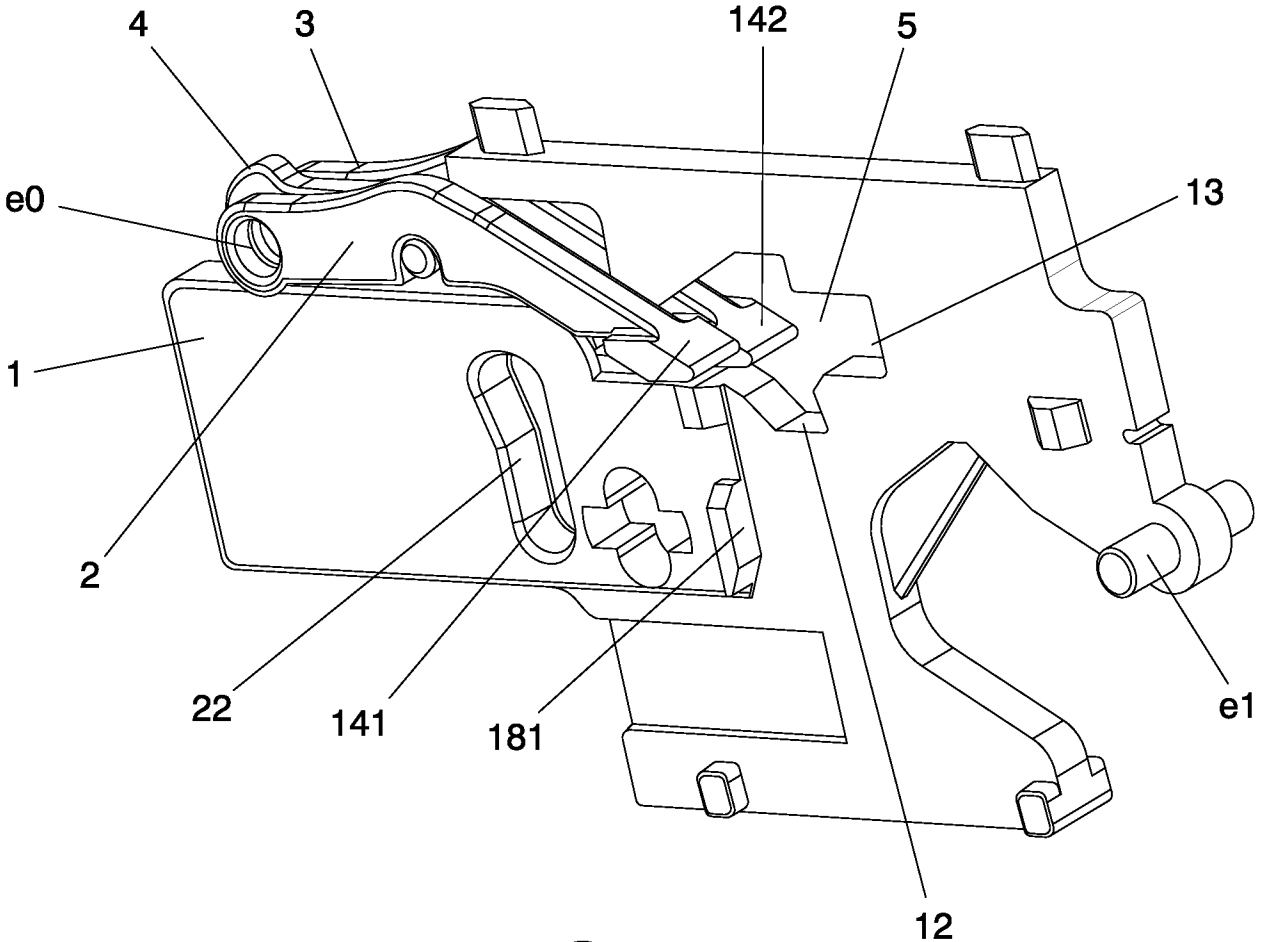
FIG. 4 shows a general diagram similar to FIG. 3, but without the lever of the tongue (20) and of the lift (23).
Figure 5:
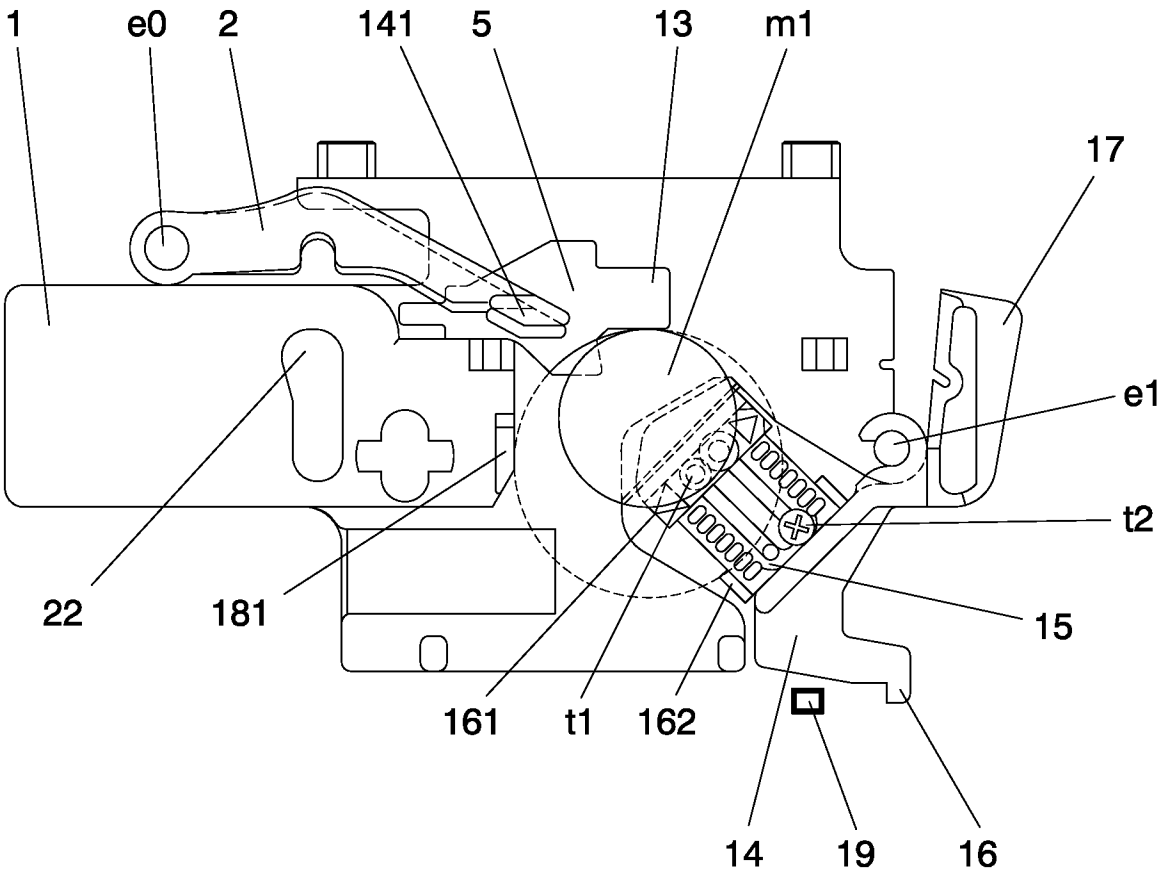
FIG. 5 shows a schematic general elevation view corresponding to the foregoing FIGS. 3 and 4, without the tongue lever (20) and without the lift (23) but with coins (m1), (m2) that may be identical or different from each other, and positioning lever (14).

The casing (11) is closed with a cover (30). Said cover (30)—see FIG. 6—presents symmetry with respect to a transverse plane C:C including in it:

- an opening (31) through which access is provided to the movable stops (161), (162) of the regulator (15)
- a structure to facilitate the positioning of a support (32) for the key cylinder, and
- both access orifices (O4), through one or the other of which access is allowed to the pin (4*a*) of the tongue stop dog (4).

The tongue (1) has a large opening (5), the contour of which perfectly delimits a lower notch (12), an end seat (13) and a front protuberance (18) which defines two fixed stops (181), (182) positioners of the coins (m1), (m2).

The tongue (1) also defines a channel (22) to house the eccentric pin (21) of a tongue lever (20) that displaces it when it is operated directly/indirectly by a key.

In addition, the tongue (1) forms a pivoting pin (e1) around which a positioning lever turns (14), equipped with respective movable stops (161), (162) for positioning the coins (m1), (m2).

In an example of embodiment, the positioning lever (14) consists of or includes:

an arm (16) which, when the tongue is retracted (1) and the positioning lever turns (14) around its pivoting axis (e1), it reaches a fixed stop (19) in the casing (11).

A lever arm (17) which extends outside through one of the two openings (7), (8) placed on the side of the casing (11) and allows its operation to manually free the coins (m1), (m2).

A regulator body (15) with orifices/slots arranged longitudinally. The movable stops (161), (162) are fastened in said orifices/slots of the regulator body (15) utilizing screws (t1), (t2)—see FIG. 6—

In an example of alternative embodiment, the positioning lever (14) eliminates said arm (16) so that, when the tongue is retracted (1) the positioning lever does not turn (14) around its pivoting axis (e1) and as a result, the coins do not fall. It is necessary to manually actuate the lever arm (17) which extends outside through one of the two openings (7), (8) placed on the side of the casing (11) and allows its operation to manually free the coins (m1), (m2).

According to the invention, and according to the embodiment shown, on each side of the tongue (1) there are two tongue stops (2), (3), equipped with respective ends (141), (142); and there is a tongue stop dog (4) engaging with one or both tongue stops (2), (3) via a pin (4*a*). The two tongue stops (2), (3), and the tongue stop dog (4) have the same pivoting axis (e0) on the casing (11).

Between the tongue lever (20) and the tongue (1) there is a lift (23), coaxially aligned with the tongue lever (20) accessible in turning from the outside by utilizing a master key. The lift (23) includes an eccentric head (231) which, on turning when operated by the master key, interferes with the tongue stop dog (4) and forces it to pivot.

According to the invention, and according to the embodiment shown, between the upper part of the tongue (1) and the upper slots (r1), (r2) inside the casing (11), there is an upper coin closure (51) and a lower coin closure (50) superimposed on each other.

The longitudinal movement of each of these closures (50), (51) is limited by stops (40) (41) in the casing itself (11).

Figure 7:
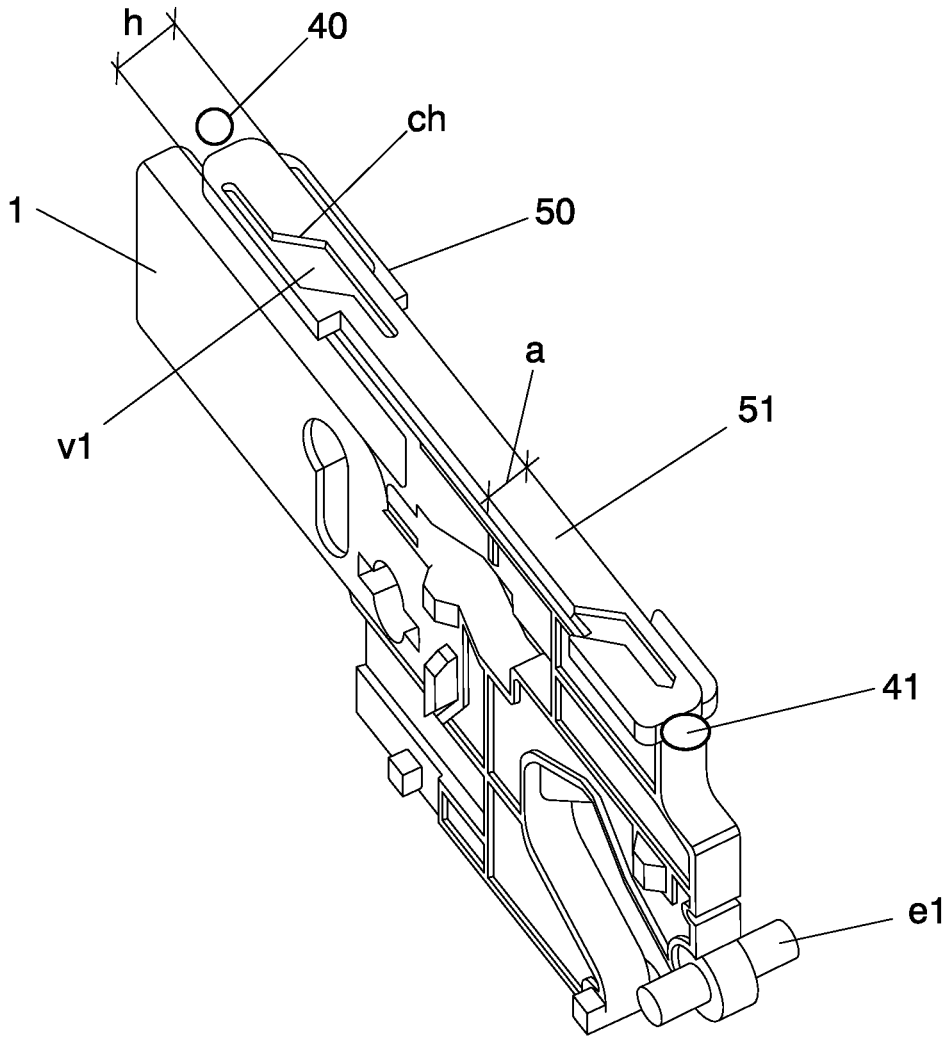
FIG. 7 shows an upper view general diagram of the coin lock which is the object of the invention without the casing (11) and cover (30) and the positioning lever (14), but with the upper coin closure (51) and the lower coin closure (50) in open position; that is, it accepts coins (m1), (m2).
Figure 8:
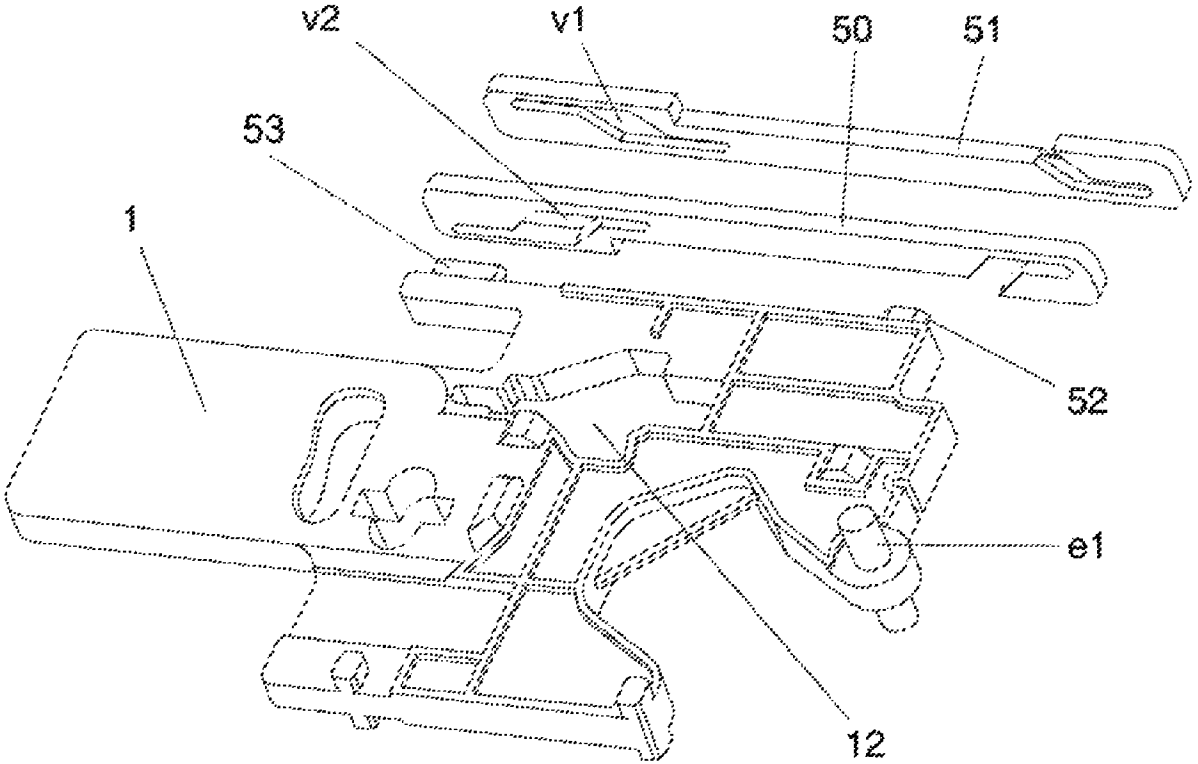
FIG. 8 shows a lower view general diagram of the coin lock which is the object of the invention, similar to FIG. 7 but with its components in assembly arrangement.

Each closure (50), (51) consists of openings (v1), (v2) in which nubs (52), (53) of the tongue can move (1) until interfering with chamfers (ch) slanted transversely in the openings (v1), (v2) which causes relative lateral displacement between both closures (50), (51) closing or opening the upper slots (r1), (r2) according to their relative position—See FIGS. 7 and 8—.

The upper coin closure (51) and the lower coin closure (50) coincide dimensionally in both their inside width (a)—in the slot zone (r2), (r2)—and in their total width (h)—see FIG. 7—. Preferably, their openings (v1), (v2) are sliding type—see FIG. 8—although it is included, and does not alter in any way the object of the invention, that the opening (v1) of the upper coin closure (51) may not be sliding type.

Both between the tongue (1) and positioning lever (14) and between the tongue (1) and casing (11) and between the tongue stops (2), (3) and casing (11) and/or tongue (1) recovery springs are arranged, which tend to displace the different interior components to their resting position. Said springs are not described in greater detail because their use (known) and their use (normal in locks), is not an object of the invention.

With this structure and arrangement and these specific details:

In the presence of coins (m1), (m2), the ends (141), (142) are positioned in alignment with the respective coins (m1), (m2) and, in the forward movement of the tongue (1), go over the notch (12), reaching the end seat (13) at the same time that the positioning lever (14) turns around (e1) and the movable stops (161), (162) go down and allow the coins to fall (m1), (m2)

In the absence of coins (m1), (m2), and in the forward movement of the tongue (1), the ends (141), (142) fall and are lodged in the notch (12), preventing the forward movement of the tongue (1) and the turning of the positioning lever (14) around (e1) with the resulting blocking of the lock In the absence of coins (m1), (m2), on actuating the master key, the lift (23) turns and its eccentric head (231) pushes on and causes the tongue stop dog to turn (4)—and as a result, the tongue stops—(2), (3) so that their ends (141), (142) are raised above the notch (12) of the opening (5) and reach the end seat (13).

The size of the coins (m1), (m2) accepted can vary by simply appropriately positioning the screws (t1), (t2) of the regulator body (15). This positioning can be done through the opening (31) of the cover (30) without disassembling the lock.

The materials, dimensions, and proportions can be variable as well as, in general, those other complementary or secondary details that do not alter, change or modify the essential proposal.

The terms in which this report is written are a true and accurate statement of the object described, and must be taken in their broadest sense and never in a limiting manner.

The invention claimed is:

1. A coin lock comprising:

a casing having two upper slots for the insertion of coins; and a tongue displaceable by action of an eccentric pivot of a tongue lever which, housed in a channel of said tongue, displaces said tongue when said tongue lever is actuated by a key, wherein:

the casing has a longitudinal plane of symmetry, and the two upper slots are adjacent to each other;

two tongue stops, each having a tongue stop end, corresponding to each coin to be inserted, and a tongue stop dog are arranged on a same pivoting axis, the tongue stop dog engaging one or both tongue stops; the two tongue stops and the tongue stop dog being arranged on the casing;

the tongue having an opening with a notch and an end seat, the notch interfering with the tongue stop ends when the tongue is displaced in the absence of coins;

the end seat for the tongue stop ends when the tongue is displaced in the presence of coins; and arranged on each side of the tongue and under the opening there are two fixed stops, both stops being fixed to the tongue; and two movable stops, both movable stops being coupled together by means of a positioning lever which is driven by the tongue via a pin on which it is able to pivot.

2. The coin lock according to claim 1, wherein between the tongue lever and the tongue there is a lift coaxially aligned with the tongue lever, the lift being accessible from the outside by turning of the key, and the lift comprising an eccentric head which, in its displacement in turning, interferes with the tongue stop dog forcing the tongue stop dog to pivot and pushing in its turning on the tongue stops so that in their pivoting they lift the tongue stop ends of the tongue stops over the notch of the opening.

3. The coin lock according to claim 1, wherein between the tongue lever and the tongue there is a lift coaxially aligned with the tongue lever, the lift being accessible from the outside by turning of the key, the lift comprising an eccentric head which, in its displacement in turning, interferes with one of the tongue stops and with the tongue stop dog, forcing them to pivot, the tongue stop dog pushing and turning the other tongue stop so that in their pivoting the tongue stop ends are raised over the notch of the opening.

4. The coin lock according to claim 1, wherein the tongue, the tongue stops the tongue stop dog and the positioning lever each have a transverse plane of symmetry.

5. The coin lock according to claim 1, wherein the casing comprises an upper cover in which slots corresponding to the upper slots have been made and the longitudinal plane of symmetry passes through the centre of both slots facing adjacent to each other.

6. The coin lock according to claim 1, wherein the casing comprises two openings on its side and a cover, and the positioning lever comprises consists of a regulator body with orifices arranged longitudinally and on which each movable stop is fastened with two screws, both screws being accessible through a single opening of the cover of the casing;

an arm which, when the tongue is displaced, reaches a stop which is fixed in the casing; and a lever arm which extends to the outside of the casing through one of the two openings on the side of the casing as an exit for the tongue.

7. The coin lock according to claim 1, wherein the casing closes with a cover; said cover having a plane of symmetry that passes through the centre of an opening and a support for a key cylinder of the lock.

8. The coin lock according to claim 7, wherein the tongue stop dog comprises a pin and the cover has two orifices, in symmetrical arrangement with respect to the plane of symmetry; such that through one of said orifices the pin of the tongue stop dog is accessed.

9. The coin lock according to claim 1, wherein the casing comprises two openings on its side and a cover, and the positioning lever comprises a regulator body with orifices arranged longitudinally and on which each movable stop is fastened with two screws, both screws being accessible through a single opening of the cover of the casing; and a lever arm that extends to the outside of the casing through one of the two openings on the side of the casing as an exit for the tongue.

10. The coin lock according to claim 1, wherein the two upper slots are identical to each other and the coins accepted in them are placed on each side of the tongue.

11. The coin lock according to claim 1, wherein the casing comprises a set of breaks, the tongue comprises a set of nubs, and between the upper part of the tongue and the upper slots there is an upper coin closure and a lower coin closure superimposed on each other; the longitudinal movement of each closure being limited by the set of breaks of the casing and each closure comprising an opening in which the nubs of the tongue can be displaced until interfering with chamfers which are slanted transversely in the opening of each closure which causes relative lateral displacement between both closures closing the upper slots.

12. A coin lock comprising:

a casing, the casing having a longitudinal plane of symmetry;

two upper slots in the casing for insertion of coins, the two upper slots adjacent to each other;

a tongue mounted in the casing, the tongue being displaceable in a horizontal direction, having a channel and an opening with a notch and an end seat;

two fixed stops, both stops arranged on each side of the tongue and under the opening;

two movable stops, both movable stops being coupled together by a positioning lever, the positioning lever being driven by the tongue via a pin on which it is able to pivot;

a tongue lever housed in the channel of the tongue, the tongue lever having an eccentric pivot, the eccentric pivot acting on the tongue to displace the tongue in the horizontal direction when the tongue lever is actuated by a key;

two tongue stops adjacent to each other, each tongue stop having a tongue stop end; and a tongue stop dog, the tongue stop dog engaging one or both tongue stops, and the two tongue stops and the tongue stop dog arranged on a pivoting axis on the casing, wherein:

the notch interferes with each tongue stop end when the tongue is displaced in the absence of coins; and the end seat for each tongue stop end when the tongue is displaced in the presence of coins.

* * * * *